US007812772B2

(12) United States Patent
Wen et al.

(10) Patent No.: US 7,812,772 B2
(45) Date of Patent: Oct. 12, 2010

(54) ANTENNA, AND ASSOCIATED METHOD, FOR A MULTI-BAND RADIO DEVICE

(75) Inventors: Geyi Wen, Waterloo (CA); Dong Wang, Waterloo (CA); Mark Pecen, Waterloo (CA)

(73) Assignee: Research In Motion Limited, Waterloo (CA)

( * ) Notice: Subject to any disclaimer, the term of this patent is extended or adjusted under 35 U.S.C. 154(b) by 61 days.

(21) Appl. No.: 11/843,851

(22) Filed: Aug. 23, 2007

(65) Prior Publication Data

US 2009/0051597 A1 Feb. 26, 2009

(51) Int. Cl.
*H01Q 1/24* (2006.01)

(52) U.S. Cl. ..... 343/702; 343/700 MS

(58) Field of Classification Search ..... 343/702, 343/700 MS

See application file for complete search history.

(56) References Cited

U.S. PATENT DOCUMENTS 7,068,230 B2 * 6/2006 Qi et al. ..... 343/702
7,196,667 B2 * 3/2007 Watada et al. ..... 343/700 MS
2002/0101382 A1 8/2002 Konishi et al.
2003/0001781 A1 1/2003 Konishi et al.
2003/0142022 A1 7/2003 Ollikainen et al.
2004/0252063 A1 12/2004 Sadamori et al.
2004/0263396 A1 * 12/2004 Sung ..... 343/702
2005/0062650 A1 * 3/2005 Furuno et al. ..... 343/700 MS
2006/0244665 A1 * 11/2006 Tung ..... 343/702
2008/0007464 A1 * 1/2008 Hsu ..... 343/702

FOREIGN PATENT DOCUMENTS

EP 1162688 A1 12/2001

* cited by examiner

*Primary Examiner*—Hoang V Nguyen

(57) ABSTRACT

Antenna apparatus, and an associated method, for a mobile station, or other radio device. A folded conducting strip is formed upon multiple sides of a cube-shaped, or other three-dimensional substrate of small dimensions. The conducting strip exhibits resonance at multiple frequencies, such as at frequencies encompassing the 800/900/1800/1900/2200 MHz frequencies. Because of the positioning of the conducting strip upon the multiple sides of the substrate, a conducting strip of increase length is provided while permitting the dimensional requirements of the antenna structure to be small. Multiple antennas are able to be positioned at the radio device to provide for multiple-input, multiple-output radio operation.

13 Claims, 9 Drawing Sheets

1800 MHz

ANTENNA, AND ASSOCIATED METHOD, FOR A MULTI-BAND RADIO DEVICE

The present invention relates generally to an antenna connectable to a mobile station, or other radio device, capable of transducing signal energy at multiple frequency bands. More particularly, the present invention relates to antenna apparatus, and an associated methodology, of compact dimensions, capable of transducing signal energy at the frequencies at which the radio device is operable, e.g., at the 800/900/1800/1900/2200 MHz frequency bands.

A folded, conducting strip is disposed, or otherwise positioned, upon a three-dimensional substrate. The folded, conducting strip is positioned upon two or more surfaces of the three-dimensional substrate and is of a configuration to be resonant at two or more frequency bands. Formation of the conducting strip upon multiple substrate surfaces permits its length to be increased without requiring the amount of surface space that would otherwise be required to provide a conducting strip of corresponding length in a two-dimensional implementation. An antenna of compact dimension and good antenna characteristics is provided. The compact dimension further permits multiple antennas to be used at the mobile station in an antenna array configuration.

BACKGROUND OF THE INVENTION

Advancements in communication technologies have permitted the development and deployment of mobile radio communication systems. Cellular, and cellular-like, communication systems are exemplary radio communication systems. The infrastructures of cellular, and other, communication systems have been widely deployed and regularly used by many. Successive generations of various types of communication systems have been developed and their operating parameters and protocols are promulgated in operating standards, promulgated by standard-setting bodies.

Various frequency allocations have been made by regulatory bodies for communications by way of radio communication systems operable pursuant to associated system standards. Mobile stations are typically utilized by users when communicating in a cellular, or other, mobile radio communication system. A mobile station is sometimes referred to as being a multi-mode mobile station when the mobile station is capable of operation by way of more than one type of mobile radio communication system. When a mobile station is positioned in an area encompassed by infrastructures of more than one mobile radio communication system with which the mobile station is operable, communications are carried out by way of a selected one of the communication systems. Selection is made, e.g., based upon a service subscription preference, user preference, or other criteria. And, when the mobile station is positioned at an area encompassed by the infrastructure of only one of the systems with which the mobile station is compatible, the mobile station communicates by way of the available system.

A multi-mode mobile station must include circuitry permitting its operation in each of the communication systems with which the mobile station is to communicate. Most simply, a mobile station is provided with multiple, independent circuitries of a number and type corresponding to the number and type of systems with which the mobile station is to operate. Sharing of common circuit portions is sometimes utilized to provide cost and size advantages.

Special challenges are presented with respect to antenna transducer elements when the different systems with which the mobile station is to operate utilize different frequencies.

The antenna transducer elements must be operable at the different frequencies of operation of the different communication systems. The size required of an antenna transducer element is typically related to the frequencies of the signal energy that is to be transduced by the transducer element. Different antenna sizes are therefore generally required for the different systems with which the mobile station is to operate. The challenges become yet greater as the mobile stations must increasingly be packaged in smaller housings. Significant attention has been directed towards the development of an antenna transducer, operable over multiple frequency bands that is also of small dimension to permit its positioning within the housing of a compact-sized mobile station. A PIFA (Planar Inverted-F Antenna) is sometimes used in multi-mode mobile stations. A PIFA is of relatively compact size, exhibits a low profile, and provides for at least dual-band radiation. A PIFA, however, generally exhibits a narrow bandwidth. And, conventional efforts to enhance the bandwidth of a PIFA generally utilize a combination of the PIFA with a parasitic element. However, addition of a parasitic element increases the size of the resultant antenna structure. A need therefore exists for an improved, antenna structure of small dimensions that is also capable for use at multiple different frequencies.

It is in light of this background information related to antenna transducers for radio devices that the significant improvements of the present invention have evolved.

DETAILED DESCRIPTION

Figure 1:
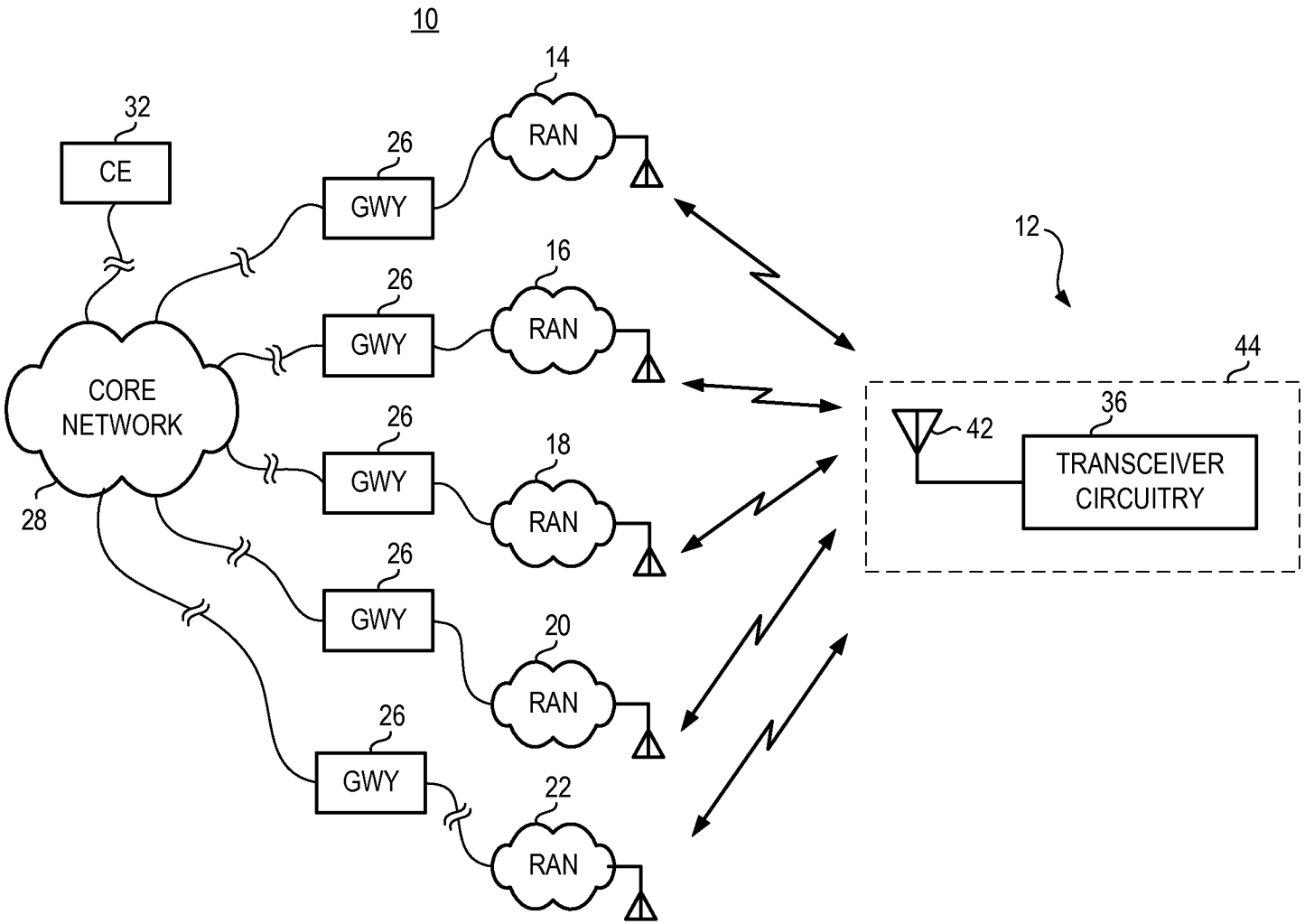
FIG. 1 illustrates a functional block diagram of a radio communication system in which an embodiment of the present invention is operable.

The present invention, accordingly, advantageously provides antenna apparatus, and an associated methodology, for a mobile station, or other radio device, capable of transducing signal energy at multiple frequency bands.

Through operation of an embodiment of the present invention, an antenna of compact dimensions, capable of transducing signal energy at the frequencies at which a radio device to which the antenna is connectable is provided. The characteristics of the antenna permit its operation at selected frequency bands over a wide range of frequencies, e.g., the 800/900/1800/1900/2200 MHz frequencies.

In one aspect of the present invention, a folded, conducting strip is disposed, or otherwise positioned, upon a three-dimensional substrate, such as a cubular-shaped substrate. The substrate, and the conducting strip disposed thereon, is mountable, or otherwise connectable, to radio circuitry embodied at a printed circuit board, or the like.

In another aspect of the present invention, the folded, conducting strip is positioned upon two or more surfaces of the three-dimensional substrate. The strip is of a configuration to be resonant at two or more frequency bands. Due to the multi-face nature of the substrate, the folded, conducting strip is configurable to be of a length to permit its resonance at multiple frequencies of operation, i.e., is of large bandwidths of resonance, while also being of compact dimensions.

In another aspect of the present invention, the antenna is used in a multiple-antenna arrangement in a mobile station That is to say, multiple three-dimensional substrates are provided, and folded, conducting strips are disposed upon the substrates. The substrates are positioned at spaced-apart locations of the printed circuit board, or the like, and connected to radio circuitry of the radio device. The multiple antenna configuration defines an antenna array, providing the radio device with the capability of MIMO (multiple input, multiple output) operation.

In another aspect of the present invention, the three-dimensional substrate is of a generally cubical configuration, defining six primary face surfaces. The folded, conducting strip disposed upon the substrate is disposed upon multiple face surfaces thereof. That is to say, a first folded portion of the conducting strip is formed upon a first face surface of the substrate, a second folded portion of the conducting strip is formed upon a second face surface of the substrate, etc. The portions of the conducting strip are integrally formed, or otherwise connected together electrically, collectively to be of a cumulative length, permitting resonance of the conducting strip at desire frequencies. Configuration of the conducting strip to be of an appropriate length and of other appropriate shape-related configuration provides for the formation of an antenna of the desired characteristics. The antenna characteristics, for instance, provide for two wideband frequency bands of resonance that encompass the 800/900/1800/1900/2200 MHz frequency ranges.

In another aspect of the present invention, a set of matching strips is further disposed, or otherwise positioned, upon the three-dimensional substrate. The set of matching strips include, for instance, a pair of matching strips that are disposed upon different face surfaces of the substrate and extend in generally opposing directions beyond the folded conducting strip portions, also disposed upon the corresponding face surfaces of the substrate. The matching strips are of configurations and are positioned to improve the return loss of the resultant antenna structure.

In another aspect of the present invention, multiple, i.e., two or more, antenna structures, each formed of folded conducting strips disposed upon three-dimensional substrates, are positioned at spaced locations upon a circuit board, e.g., a circuit board upon which radio circuitry of a radio transceiver is positioned. The respective antennas are connected at feeding points thereof to the radio circuitry, e.g., by way of lead lines disposed upon the circuit board and leading to the radio circuitry. The spaced-apart nature of the respective structures provides spatial diversity, permitting MIMO operation of the radio device that facilitates communication of data communicated during operation of the radio device.

As the three-dimensional substrate provides multiple face surfaces, extending in different planar directions, the dimensional requirements of the antenna structure are reduced relative to conventional implementations. And, due to the reduced dimensional requirements, multiple antennas are positionable at a mobile station, permitting MIMO operation. Improved radio performance is provided by providing a structure of compact dimensions and good antenna characteristics.

In these and other aspects, therefore, an antenna apparatus, and associated method, is provided for transducing signal energy at a radio communication station. A first, three-dimensional substrate is provided. A first folded conducting strip is positioned upon the three-dimensional substrate. The first folded conducting strip has a first folded portion that is positioned at a first side of the first three-dimensional substrate. And, the strip includes at least a second folded portion positioned at least at a second side of the three-dimensional substrate. The first folded conducting strip is of a shape to be resonant at a first frequency band and at a second frequency band. A first set of matching strips is formed integral with the first folded conducting strip. The matching strips are also positioned upon the first three-dimensional substrate.

Turning, therefore, first to FIG. 1, a radio communication system, shown generally at 10, provides for radio communications with mobile stations, of which the mobile station 12 is representative. The mobile station 12 is here representative of a multi-mode mobile station, capable of communicating at the 800/900/1800/1900/2200 MHz frequency bands. Such a mobile station is sometimes referred to as a world-band mobile station as the mobile station is operable in conformity with the operating specifications and protocols of the cellular, and other, communication systems that presently are predominant. More generally, the mobile station is representative of various radio devices that are operable over multiple bands or large bandwidths at relatively high frequencies.

Radio access networks 14, 16, 18, 20, and 22 are representative of five radio networks operable respectively at the 800, 900, 1800, 1900, and 2200 MHz frequency bands, respectively. When the mobile station 12 is positioned within the coverage area of any of the radio access networks 14-22, the mobile station is capable of communicating therewith. If the separate networks have overlapping coverage areas, then the selection is made as to which of the networks through which to communicate. The radio access networks 14-22 are coupled, here by way of gateways (GWYs) 26 to a core network 28. A communication endpoint (CE) 32 that is representative of a communication device that communicates with the mobile station.

The mobile station 12 includes a radio transceiver having transceiver circuitry 36 capable of transceiving communication signals with any of the networks 14-22. The transceiver circuitry includes separate or shared transceiver paths constructed to be operable with the operating standards and protocols of the respective networks. The radio station further includes an antenna 42 of an embodiment of the present invention. The antenna is of characteristics to be operable at the different frequency bands at which the transceiver circuitry and the radio access networks are operable. Here, the antenna 42 is operable at the 800, 900, 1800, 1900, and 2200 MHz frequencies. In the exemplary implementation, the antenna 42 is housed together with the transceiver circuitry, in a housing 44 of the mobile station. As the space within the housing that is available to house the antenna is limited, the dimensions of the antenna 42 are correspondingly small while providing for the transducing of signal energy by the antenna over broad frequencies at which the mobile station is operable.

Figure 2:
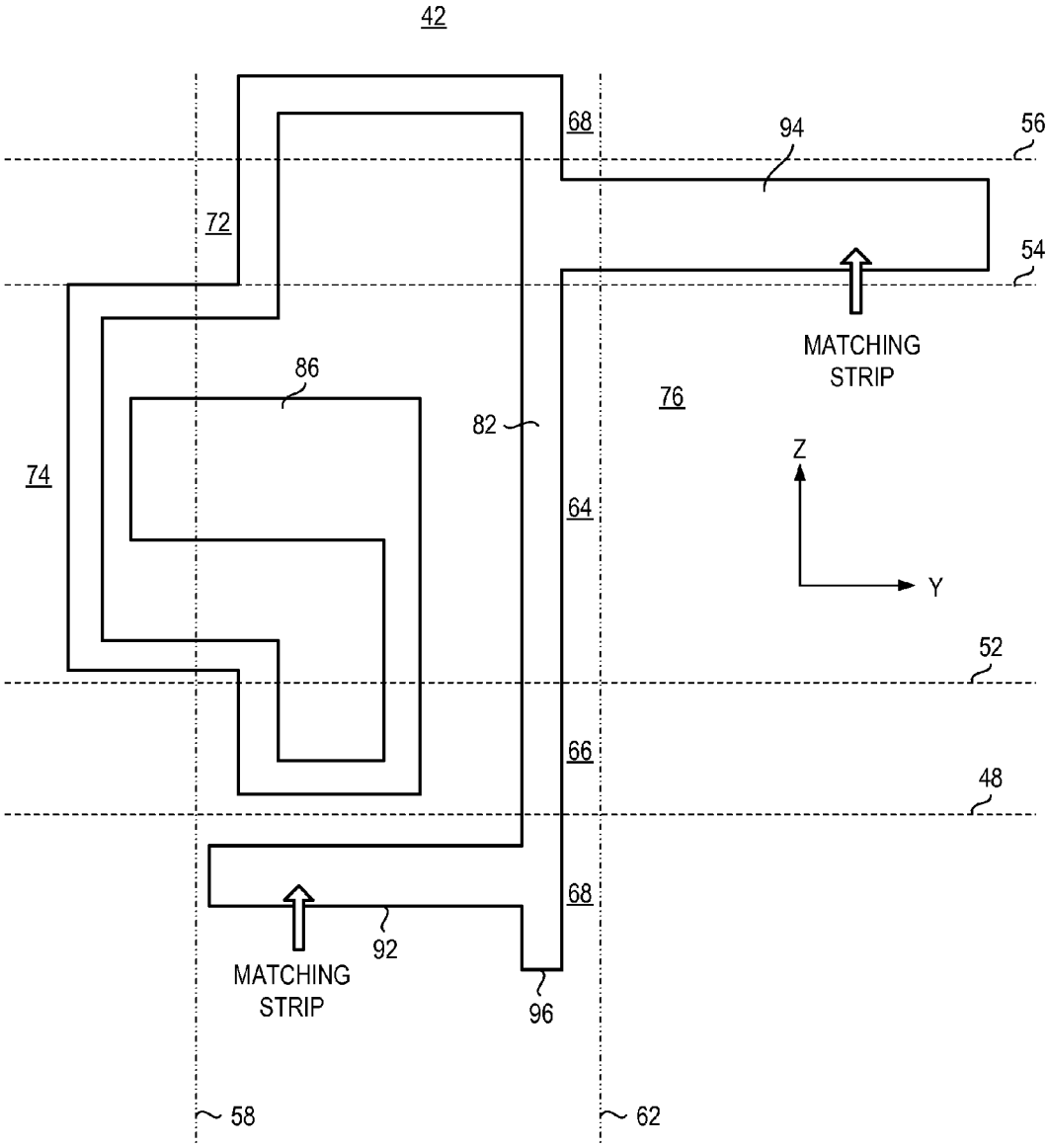
FIG. 2 illustrates a planar view of part of the antenna of an embodiment of the present invention.

FIG. 2 illustrates the antenna 42 that forms part of the mobile station 12, shown in FIG. 1. The antenna 42, in the exemplary implementation, forms a pent-band antenna, having bands of resonance encompassing five frequencies ranges associated with five communication systems with which the antenna is connectable is operable. The illustration of FIG. 2 forms a planar configuration. That is to say, the representation shown in FIG. 2 illustrates the antenna prior to configuration into tri-dimensional form. The illustration shows the pattern of the conductive parts of the antenna that are disposed upon a three-dimensional substrate, here a cubular-shaped substrate. The illustration also shows fold lines 48, 52, 54, 56, 58, and 62 corresponding to folds of the pattern about the cubular substrate upon which the conductive portions of the antenna are disposed, or otherwise positioned. As the cubular substrate includes six face sides, the number of fold lines provide for presence of conductive antenna parts on any of the six sides. Here, conductive parts are disposed upon a first side 64, a second side 66, a third side 68, a fourth side 72, and a fifth side 74. In this implementation, a sixth side 76 includes an antenna matching strip 94. As the fold lines indicate, the cubular-shaped substrate upon which the conductive parts of the antenna are formed is of generally rectangular dimensions. That is to say, height, width, and depth dimensions are dissimilar. In other implementations, other configurations are instead utilized.

The conductive part of the antenna includes a conducting strip 82 formed of multiple portions, including portions on different ones of the face surfaces, including portions on different ones of the face surfaces of the underlying substrate. Here, portions are formed at the first surface 64, the second surface 66, the third surface 68, the fourth surface 72, the fifth surface 74 and the sixth surface 76. Each portion of the conductive strip 82 has a lengthwise dimension, and the cumulative lengths of the portions together define a total length of the conducting strip. As the resonance of the conducting strip is dependent, in part, upon its length, configuration of the conducting strip is configured to be of a desired cumulative length that causes the conductive strip to be resonant at desired frequencies. The conducting strip further includes an enlarged end portion 86 to improve the match, here formed at the first and fifth surfaces 64 and 74, whose dimensions are also, in part, determinative of the antenna characteristics of the antenna structure, including the conducting strip.

A set of matching strips, here a pair of matching strips 92 and 94, are integrally formed, and electrically connected with, the conducting strip 82. The strips 92 and 94 are of configurations and are positioned in manners to improve the return loss of the resultant antenna structure at low and high frequency band respectively. In the illustrated implementation, the matching strip 92 is formed at the third face surface 68 and matching strip 94 is formed at the sixth face surface 76. And, the matching strips are formed to extend along axes that are generally perpendicular to the axis along which the intersecting part of the conducting strip extends.

A feeding connection point 96 is also defined at another end portion of the conducting strip. The feed connection point provides a point of connection with an active part of radio transceiver circuitry.

Figure 3:
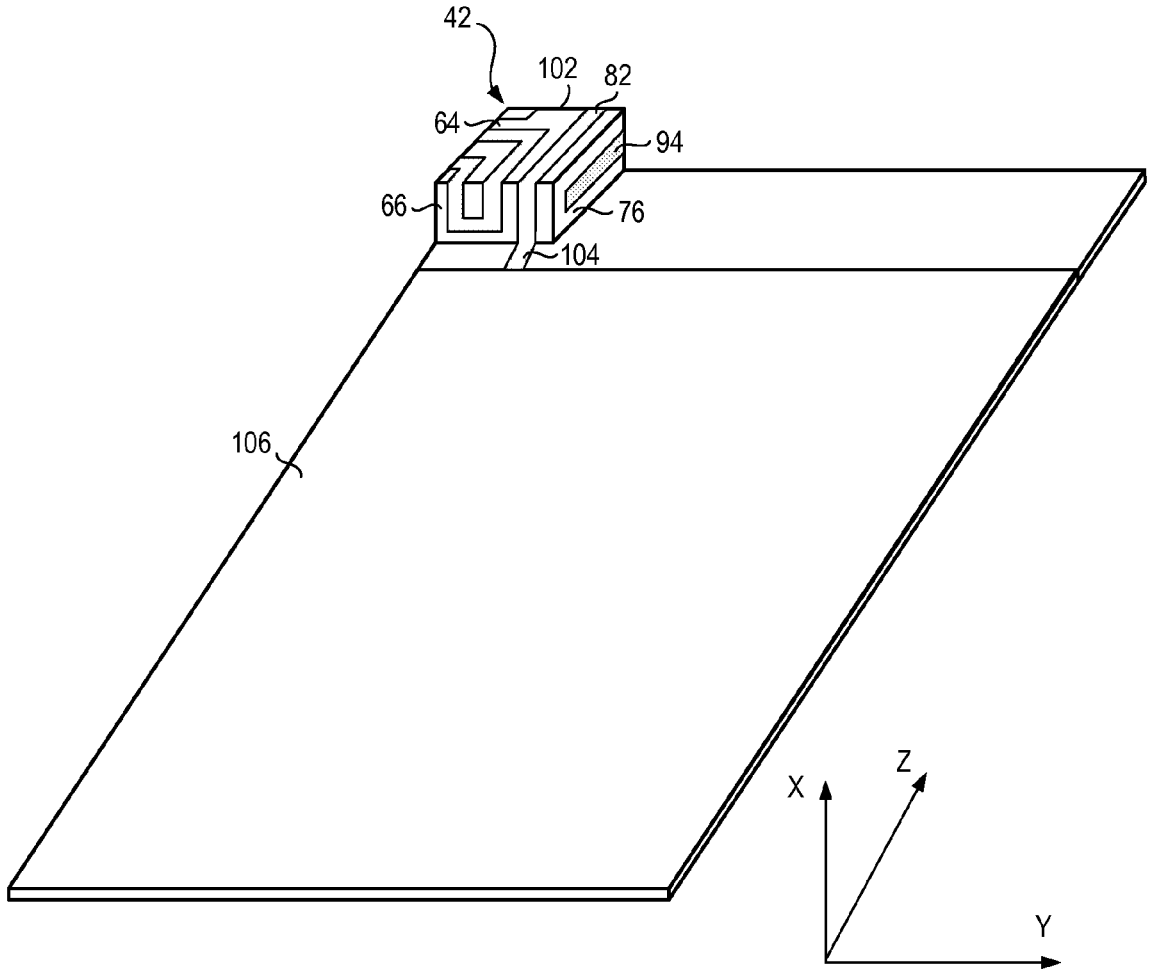
FIG. 3 illustrates a perspective view of the antenna of an embodiment of the present invention of which a part thereof is shown in FIG. 2.

FIG. 3 again illustrates the antenna 42. Here, the conducting strip 82, shown in FIG. 2, is disposed upon a cubular-shaped substrate 102, having heightwise, lengthwise, and widthwise dimensions permitting of formation of portions of the conducting strip on various of the face surfaces of the substrate. In the view shown in FIG. 3, the first side 64, the second side 66, and the sixth side 76 are visible. A path 104 leading to the feed connection point (shown in FIG. 2) is also represented. The path is disposed upon a circuit board 106 at which radio circuitry (not separately shown) is positioned. In the exemplary implementation, the antenna, formed of the cube upon which the folded conducting strip is disposed, is of dimensions of 7 mm×15 mm×7 mm. The substrate comprises a dielectric substrate, and the antenna volume is 0.75 cubic mm. And, when mounted upon the printed circuit board, the antenna extends to a height, h, above a ground plane defined at the printed circuit of 7 mm. And, in the illustrated implementation, the ground panel at which the ground plane is defined, is of rectangular dimensions of 60 mm by 90 mm. And, the substrate 102 comprises an FR-4 dielectric substrate of a 1.5 mm thickness and relative permittivity of 4.4.

Figure 4:
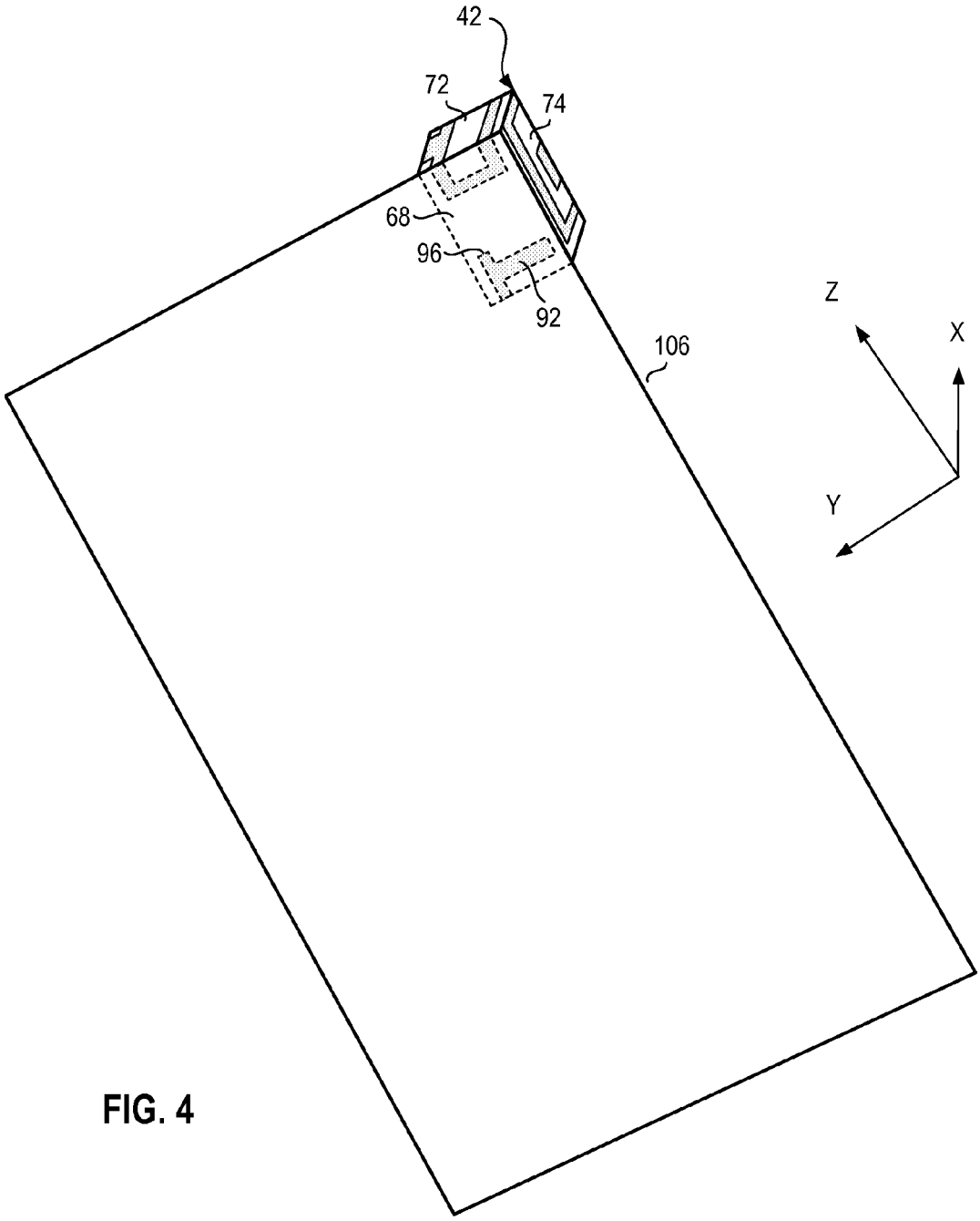
FIG. 4 illustrates another perspective view, taken from a different angle of the antenna shown in FIG. 3.

FIG. 4 again illustrates the antenna 42, here taken from another view. In the view shown in FIG. 3, the face sides 72 and 74 are visible. Again, the substrate 102 is mounted upon the circuit board 106.

Figure 5:
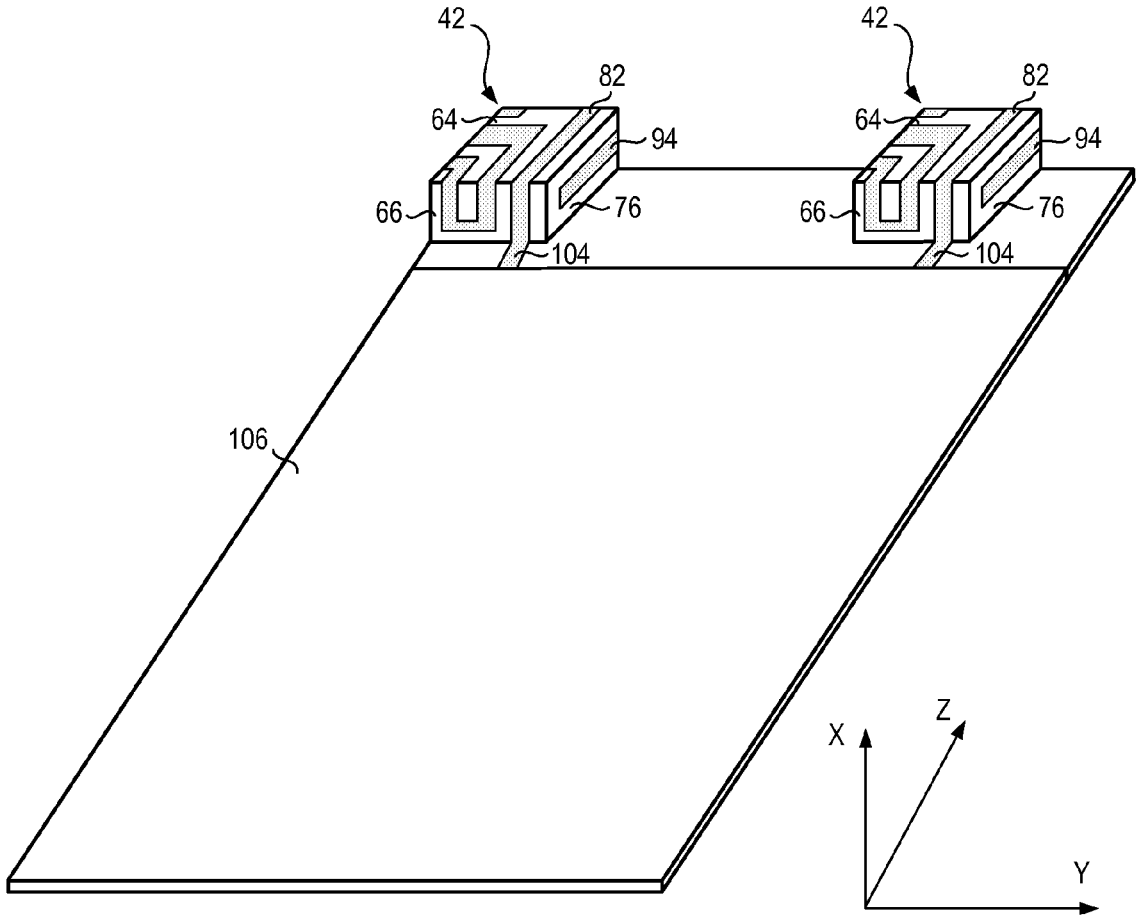
FIG. 5 illustrates a perspective view of an antenna array of an embodiment of the present invention.

FIG. 5 illustrates an arrangement of a further embodiment of the present invention. Here, more than one antenna 42 is utilized. In the illustrated embodiment, a two-antenna arrangement provides two antennas 42, each of constructions as described with respect to the previous figures, mounted upon the printed circuit board 106. The small physical dimensions of the antennas permit more than one antenna to be positioned at the printed circuit board. Use of the multiple antennas provides for the formation of an antenna array and MIMO (multiple input, multiple out) operation. Through appropriate positioning of the antennas relative to one another and with appropriate spacing therebetween, spatial diversity is provided that facilitates communication of data during communication operations of a radio device to which the antennas are connected.

Figure 6:
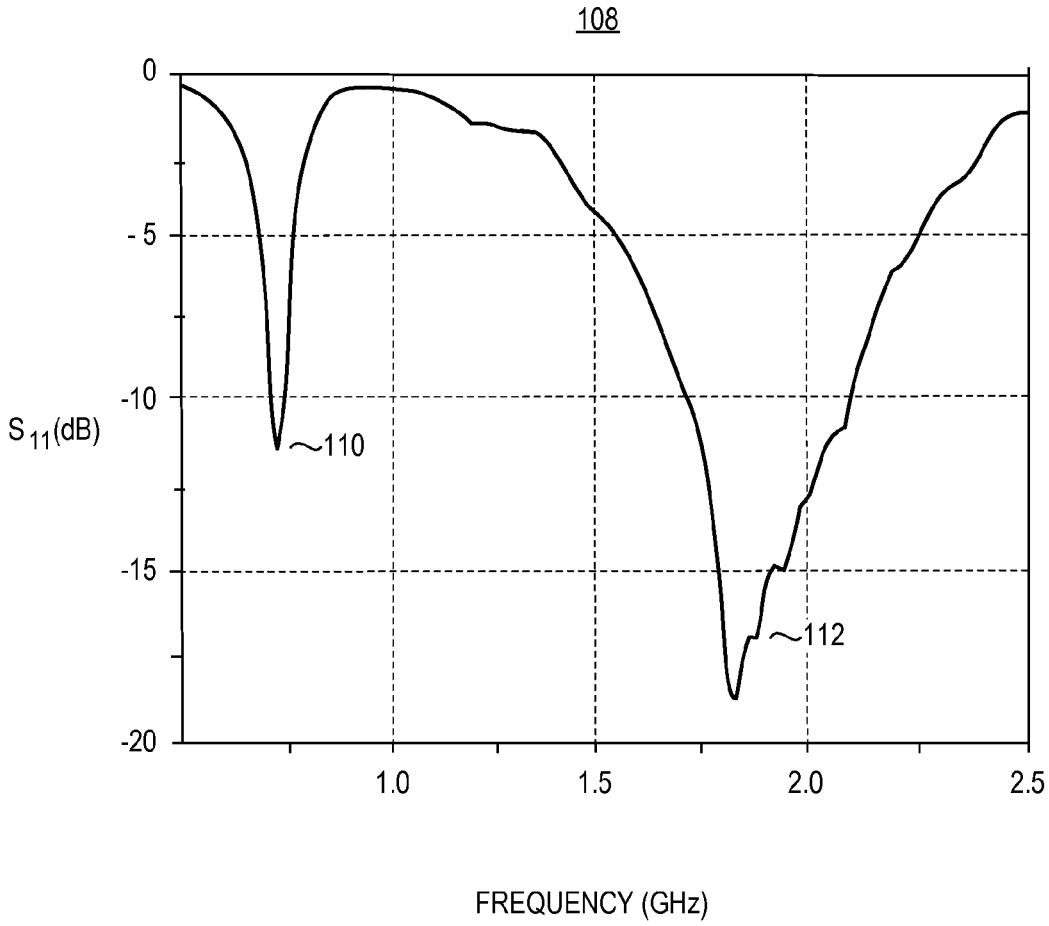
FIG. 6 illustrates a graphical representation of the return loss of an exemplary antenna of an embodiment of the present invention.

FIG. 6 illustrates a graphical representation 108 that shows exemplary return loss of an exemplary antenna 42 shown in any of the preceding figures. Review of the representation illustrates pass bands 110 and 112. Through appropriate selection of the configuration of the antenna, these pass bands are located at other frequencies.

Figure 7:
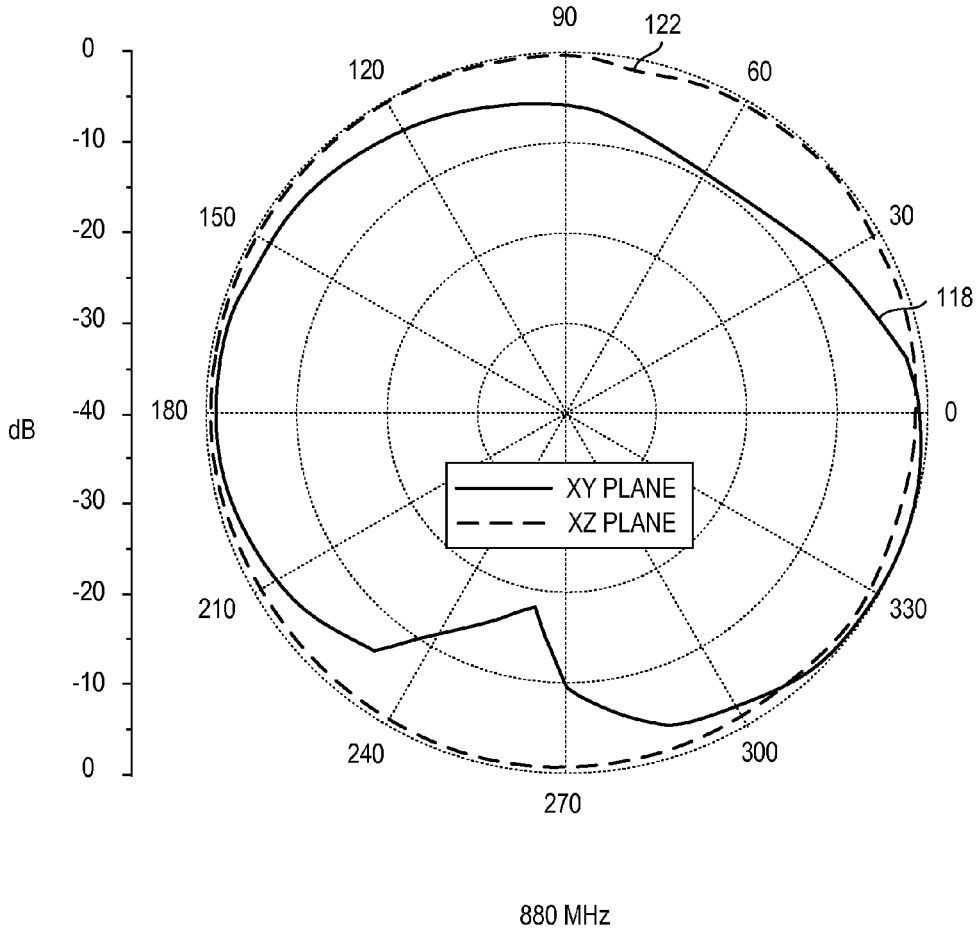
FIGS. 7 and 8 illustrate radiation patterns of the antenna of an embodiment of the present invention.
Figure 8:
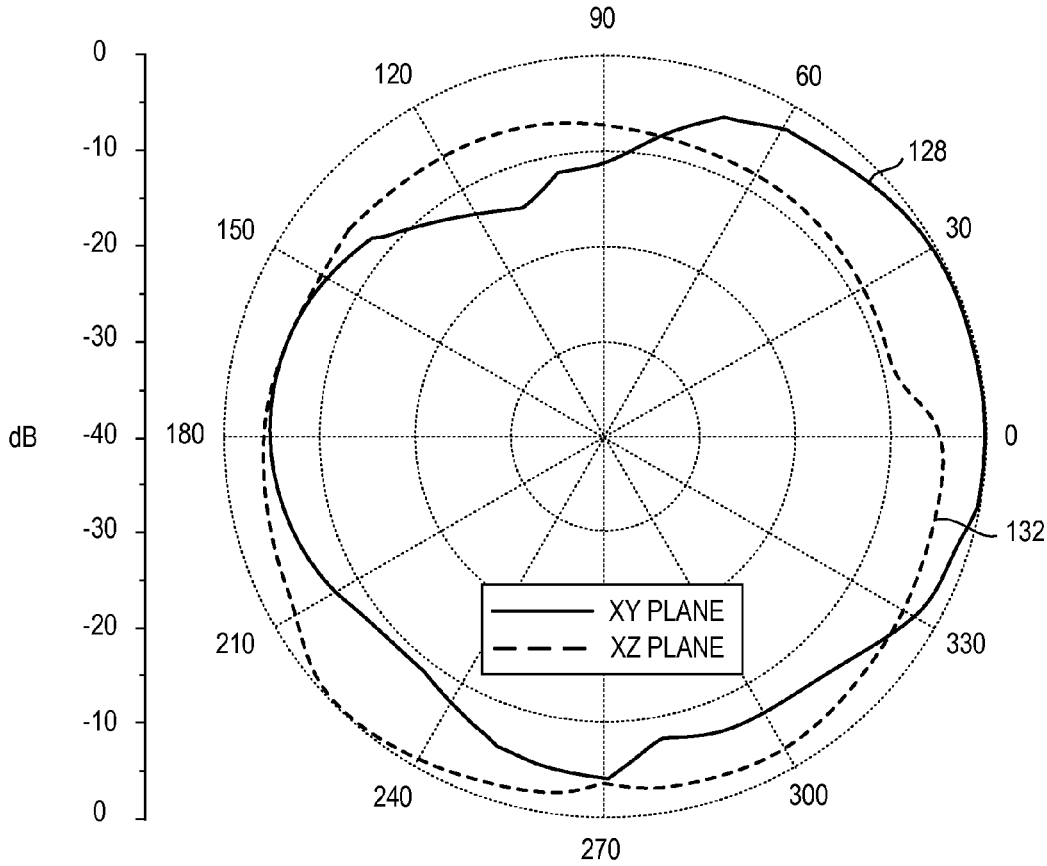

FIGS. 7 and 8 illustrate exemplary radiation patterns exhibited by the antenna 42 in an exemplary implementation. In FIG. 7, a first plot 118 is representative of the radiation pattern at 880 MHz in the XY plane. And, the curve 122 is representative of a second radiation pattern, also at the 880 MHz frequency, but in an XZ plane.

Analogously, in FIG. 8, a first radiation pattern 128 is representative of the radiation pattern at 1800 MHz in the XY plane. And, the radiation pattern 132 is representative of the radiation pattern, at the same frequency, but in the XZ plane.

Figure 9:
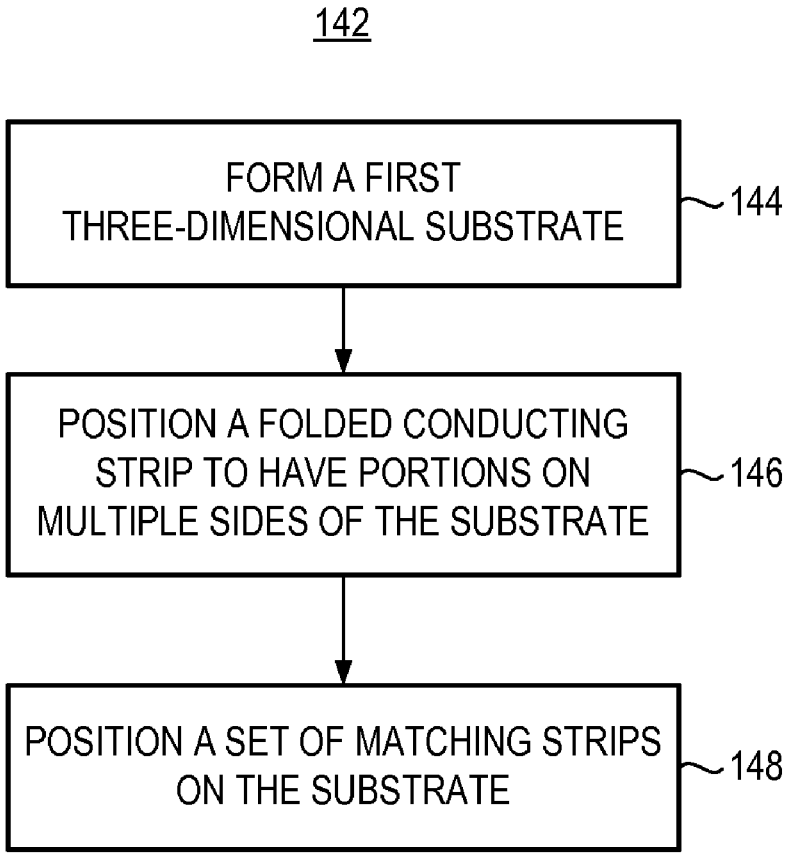
FIG. 9 illustrates a method flow diagram representative of the method of operation of an embodiment of the present invention.

FIG. 9 illustrates a method flow diagram shown generally at 142, representative of the method of operation of an embodiment of the present invention. The method transuces signal energy at a radio device.

First, and as indicated by the block 144, a first three-dimensional substrate is formed. Then, and as indicated by the block 146, a first folded conducting strip is formed upon the substrate. The strip includes a first folded portion positioned on a first face side of the substrate, and a second folded portion positioned on a second face side of the substrate.

And, the method further comprises the operation, indicated by the block 148, of positioning a first set of matching strips, formed integral with the conducting strip, upon the substrate. When an antenna array configuration is to be utilized, the method is repeated to form a second antenna, and the antennas are positioned in a desired, spatial arrangement.

Due to the tri-dimensional configuration of the antenna, a multi-band antenna is formed, of compact configuration, facilitating its use together with a mobile station, or other portable radio device.

Presently preferred embodiments of the invention and many of its improvements and advantages have been described with a degree of particularity. The description is of preferred examples of implementing the invention, and the description of preferred examples is not necessarily intended to limit the scope of the invention. The scope of the invention is defined by the following claims.

What is claimed is:

1. Antenna apparatus for transducing signal energy at a radio communication station, said antenna apparatus comprising:

a first three-dimensional substrate;

a first folded conducting strip positioned upon said three dimensional substrate, said first folded conducting strip having a first folded portion positioned at a first side of said first three dimensional substrate and at least a second folded portion positioned at least at a second side of said three dimensional substrate, said first folded conducting strip of a shape to be resonant at a first frequency band and at a second frequency band;

a first set of matching strips formed integral with said first folded conducting strip and positioned upon said first three-dimensional substrate;

wherein said first three-dimensional substrate comprises a generally cubular-shaped substrate; and wherein said first folded conducting strip further comprises a third folded portion positioned at a third side of the cubular-shaped substrate, a fourth folded portion positioned at a fourth side of the cubular-shaped substrate, a fifth side of the cubular-portion positioned at a fifth side of the cubular-shaped substrate, and a sixth folded portion position positioned at a sixth side of the cubular-shaped substrate.

2. Antenna apparatus for transducing signal energy at a radio communication station, said antenna apparatus comprising:

a first three-dimensional substrate;

a first folded conducting strip positioned upon said three dimensional substrate, said first folded conducting strip having a first folded portion positioned at a first side of said first three dimensional substrate and at least a second folded portion positioned at least at a second side of said three dimensional substrate, said first folded conducting strip of a shape to be resonant at a first frequency band and at a second frequency band;

a first set of matching strips formed integral with said first folded conducting strip and positioned upon said first three-dimensional substrate;

wherein the radio communication station comprises a multi-mode communication station operable at a plurality of frequencies and wherein the first and second frequency bands at which said first folded conducting strip is resonant includes the plurality of frequencies at which the multi-mode communication station operates; and wherein the multi-mode communication station operates at five frequency ranges and wherein the first and second frequency bands at which said first folded conducting strip is resonant includes the five frequency ranges.

3. Antenna apparatus for transducing signal energy at a radio communication station, said antenna apparatus comprising:

a first three-dimensional substrate;

a first folded conducting strip positioned upon said three dimensional substrate, said first folded conducting strip having a first folded portion positioned at a first side of said first three dimensional substrate and at least a second folded portion positioned at least at a second side of said three dimensional substrate, said first folded conducting strip of a shape to be resonant at a first frequency band and at a second frequency band;

a first set of matching strips formed integral with said first folded conducting strip and positioned upon said first three-dimensional substrate; and wherein said first folded conducting strip further comprises a third folded portion positioned at a third side of the three-dimensional substrate, a fourth folded portion positioned at a fourth side of the three-dimensional substrate, and a fifth folded portion positioned at a fifth side of the three-dimensional substrate.

4. Antenna apparatus for transducing signal energy at a radio communication station, said antenna apparatus comprising:

a first three-dimensional substrate;

a first folded conducting strip positioned upon said three dimensional substrate, said first folded conducting strip having a first folded portion positioned at a first side of said first three dimensional substrate and at least a second folded portion positioned at least at a second side of said three dimensional substrate, said first folded conducting strip of a shape to be resonant at a first frequency band and at a second frequency band;

a first set of matching strips formed integral with said first folded conducting strip and positioned upon said first three-dimensional substrate; and wherein said first set of matching strips comprises a first pair of matching strips configured to extend in opposing directions at opposing sides of said first folded conducting strip.

5. The antenna apparatus of claim 4 wherein the matching strips of the first pair are positioned at different sides of said three-dimensional substrate.

6. Antenna apparatus for transducing signal energy at a radio communication station, said antenna apparatus comprising:

a first three-dimensional substrate;

a first folded conducting strip positioned upon said three dimensional substrate, said first folded conducting strip having a first folded portion positioned at a first side of said first three dimensional substrate and at least a second folded portion positioned at least at a second side of said three dimensional substrate, said first folded conducting strip of a shape to be resonant at a first frequency band and at a second frequency band;

a first set of matching strips formed integral with said first folded conducting strip and positioned upon said first three-dimensional substrate;

a second three-dimensional substrate;

a second folded conducting strip positioned upon said second three dimensional substrate, said second folded conducting strip having a first folded portion positioned at a first side of said second three dimensional substrate and at least a second folded portion positioned at least at a second side of said three dimensional substrate, said second folded conduction strip of a shape to be resonant at a third frequency band and at a fourth frequency band; and a second set of matching strips formed integral with the second folded conducting strip and positioned upon said second three-dimensional substrate.

7. The antenna apparatus of claim 6 wherein the first and second frequency bands at which said first folded conducting strip is resonant include the third and fourth frequency bands at which said second folded conducting strip is resonant.

8. The antenna apparatus of claim 6 wherein said second conducting strip further comprises a second feed connection connectable to the radio communication station.

9. The antenna apparatus of claim 6 wherein said first three dimensional substrate is offset from said second three dimensional substrate.

10. An antenna array for a mobile station having radio circuitry disposed at a circuit board said antenna array comprising:

a first antenna element having a first conducting strip and a first three dimensional substrate, the first three dimensional substrate mounted at the circuit board, and the first conducting strip folded about a plurality of surfaces of the first three dimensional substrate; and at least a second antenna element having a second conducting strip and a second three dimensional substrate, the second three dimensional substrate mounted at the circuit board and the second conducting strip folded about a plurality of surfaces of the second three dimensional substrate, said first and second antenna elements, respectively, together operable to transduce signal energy during operation of the mobile station.

11. A method for transducing signal energy at a radio communication station, said method comprising the operations of:

forming a first three-dimensional substrate;

positioning a first folded conducting strip upon the first three-dimensional substrate with a first folded portion thereof positioned at a first side of the first three dimensional substrate and a second folded portion thereof positioned at a second side of the first three dimensional substrate, the first folded conducting strip of a shape to be resonant at a first frequency band and at a second frequency band; and positioning a first set of matching strips, integral with the first folded conducting strip, upon the first three dimensional substrate;

forming a second three dimensional substrate;

positioning a second folded conducting strip upon the second three dimensional substrate with a first folded portion thereof positioned at a first side of the second three dimensional substrate and a second folded portion thereof positioned at a second side of the second three dimensional substrate, the second folded conducting strip of a shape to be resonant at a third frequency band and at a fourth frequency band; and positioning a second set of matching strips integral with the second folded conducting strip upon the second three dimensional substrate.

12. The method of claim 11 further comprising the operation of connecting the second folded conducting strip, at a feed connection thereof, to the radio communication station.

13. The method of claim 11 further comprising the operation of positioning the first and second three dimensional substrates relative to one another to form an antenna array of the first and second folded conducting strips.

* * * * *